United States Patent [19]

Eckels

[11] 4,448,571

[45] May 15, 1984

[54] PANEL SYSTEM FOR SLOPE PROTECTION

[76] Inventor: Robert Y. Eckels, 4035 Trey Dr., Houston, Tex. 77084

[21] Appl. No.: 325,751

[22] Filed: Nov. 30, 1981

[51] Int. Cl.[3] ..... E02D 29/02

[52] U.S. Cl. ..... 405/284; 405/258; 405/262

[58] Field of Search ..... 405/284, 285, 286, 262, 405/258, 272, 273; 52/589, 590, 591

[56] References Cited

U.S. PATENT DOCUMENTS

| | | | |
|---|---|---|---|
| 250,635 | 12/1881 | McLean | 405/284 |
| 3,269,125 | 8/1966 | Moore | 405/286 |
| 3,686,873 | 8/1972 | Vidal | 405/262 |
| 3,953,979 | 5/1976 | Kurose | 405/286 |
| 4,193,718 | 3/1980 | Wahrendorf et al. | 405/262 |
| 4,278,364 | 7/1981 | Frehner | 405/284 |

FOREIGN PATENT DOCUMENTS

| | | | |
|---|---|---|---|
| 606641 | 11/1978 | Switzerland | 405/284 |

*Primary Examiner*—Dennis L. Taylor

*Attorney, Agent, or Firm*—Francis B. Francois; Francis D. Thomas, Jr.

[57] ABSTRACT

Man portable panels are utilized to provide slope protection to a watercourse, the panels being placed in vertical layers, and being secured in place by deadman elements buried in earth fill behind the panels. In one preferred embodiment the panels are made of weathering steel and are L-shaped in cross-section, and in a second preferred embodiment each panel is comprised of interlocked rectangular sections of extruded plastic.

4 Claims, 5 Drawing Figures

TOP OF BANK
CHANNEL BOTTOM
1
2
3
4
5
6
7
9
22
23
24
25
28
32
33
34
35
42
43
44
45

TOP OF BANK
(VARIES)
WATER ELEV.
CHANNEL BOTTOM

PANEL SYSTEM FOR SLOPE PROTECTION

TECHNICAL FIELD OF THE INVENTION

The present invention relates generally to a system of slope protection for water bearing earthen channels, and more particularly to a system employing relatively light in weight panels which are installed on watercourse slopes utilizing anchoring means and which protect the slopes from erosion.

BACKGROUND OF THE INVENTION

The need to protect the slopes of earthen channels utilized to handle the runoff occurring after rains is common, such channels often being employed in residential and other construction. The slopes are protected to prevent bank erosion due to stream velocities in the watercourse, and due to overland flow approaching the watercourse from directions more or less perpendicular to the direction of flow.

The normally used methods of slope protection require the use of expensive materials and extensive construction procedures, resulting in relatively large costs. Typically, the contractor will make use of reinforced concrete poured on the site, stone riprap, and the like. In addition to being costly, watercourses protected by these methods often have a stark, regular appearance, which is sometimes undesirable in the natural environment. Further, the construction activity involved requires large working areas along the channel, and often the heavy equipment utilized will itself cause bank damage and damage to the surrounding environment.

There is need for an improved system for protecting watercourse slopes, one that will significantly lower costs over present systems, be easier to install, and provide a more sightly appearance. The present invention is intended to satisfy that need.

BRIEF SUMMARY OF THE INVENTION

In the present invention watercourse slope protection is provided by utilizing preformed panels, made of steel, plastic, or other suitable materials, which can be easily carried by a workman to the slope area and installed without utilizing heavy equipment. In one preferred embodiment, the panels are made of so-called weathering steel, which has the characteristic of rusting to the point where the steel is protected from further deterioration, after which the rusting action ceases. This kind of steel is especially adaptable for the slope protection system of the invention, and offers the added advantage of being attractive after installation is completed and the weathering process ends.

In a second preferred embodiment of the invention, the panels are made up at the site from extruded rectangular sections of plastic, designed with interlocking longitudinal tongues and grooves so they can be easily assembled into different panel configurations. The extruded sections are economical, and offer the added advantage of providing interior channels that can be used in the manner of conduit to hold electrical wiring and the like for facilities located along the watercourse or in the vicinity.

The panels of both preferred embodiments are placed in vertical layers. The bottommost panel is placed first, and specially designed deadman anchor devices are secured thereto to extend from its rear face. The area behind the lowermost panel is then filled with earth to secure the deadman device, and then another panel is placed upon it. This continues until the slope is sufficiently protected. Preferably, the vertical panel layers are progressively stepped back to provide an attractive slope, and one with a proper angle to assure it will function as designed.

The panels of the first embodiment are generally L-shaped, to assist in forming the stepped slope wall. In the second embodiment, the extruded rectangular sections with their interlocking tongues and grooves make it possible to easily form the stepped configuration.

It is the principle object of the present invention to provide a system for erosion protection of the banks of earthen channels that utilizes panels and accessories which are manufactured offsite, and which are easily transported to the site by hand and installed with hand tools.

Another object is to provide an erosion protection system for channel slopes wherein the components are light in weight, and can be installed without the need for heavy equipment or large work and access areas.

Yet another object is to provide an erosion protection system for channel slopes which is non-corrosive and essentially maintenance free, so as to minimize repairs and the need to utilize maintenance easement access areas.

A further object is to provide an erosion protection system that lends itself to landscaping purposes, and which is designed to facilitate slope plantings.

It is also an object to provide an erosion protection system wherein the anchoring assembly is easily manufactured and installed.

Other objects and many of the attendant advantages of the present invention will become readily apparent from the following Description of the Preferred Embodiments, when taken in connection with the accompanying drawings.

DESCRIPTION OF THE PREFERRED EMBODIMENTS

The panel system of the invention can take different forms, and the panels can be made of different materials. For example, the panels can be constructed of metal, plastic, fiberglass or the like, and can take different configurations. The panels can be of one piece, or formed from a plurality of sections. However, it has been found that there are two preferred embodiments of the invention, which for reasons of economy, ease of installation, usefulness, and final appearance are regarded as superior to other possible embodiments.

Figure 1:
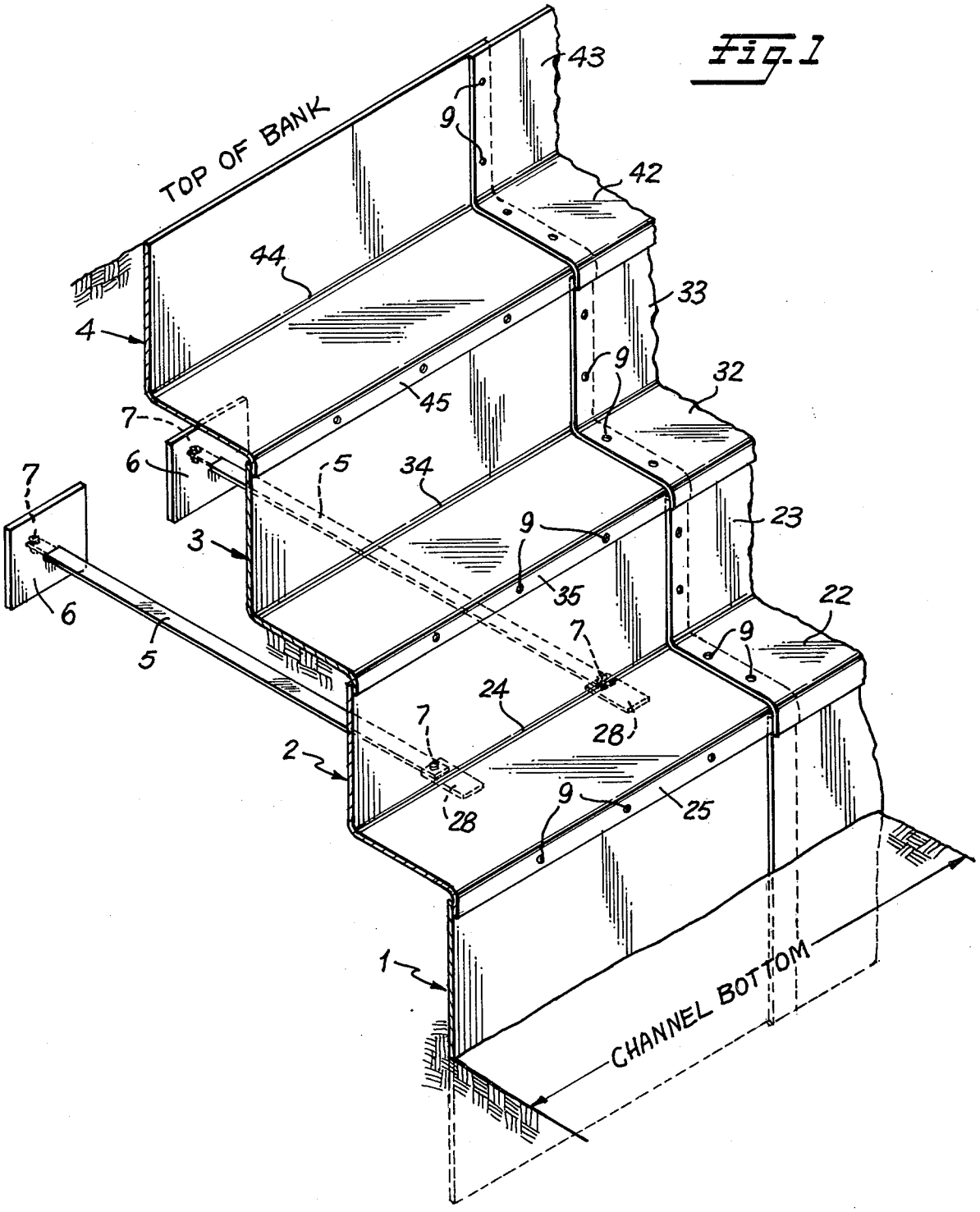
FIG. 1 is a perspective, diagrammatic view showing a first embodiment of the channel panel erosion protection system of the invention, utilizing generally L-shaped panels secured in position with deadman anchoring devices.
Figure 2:
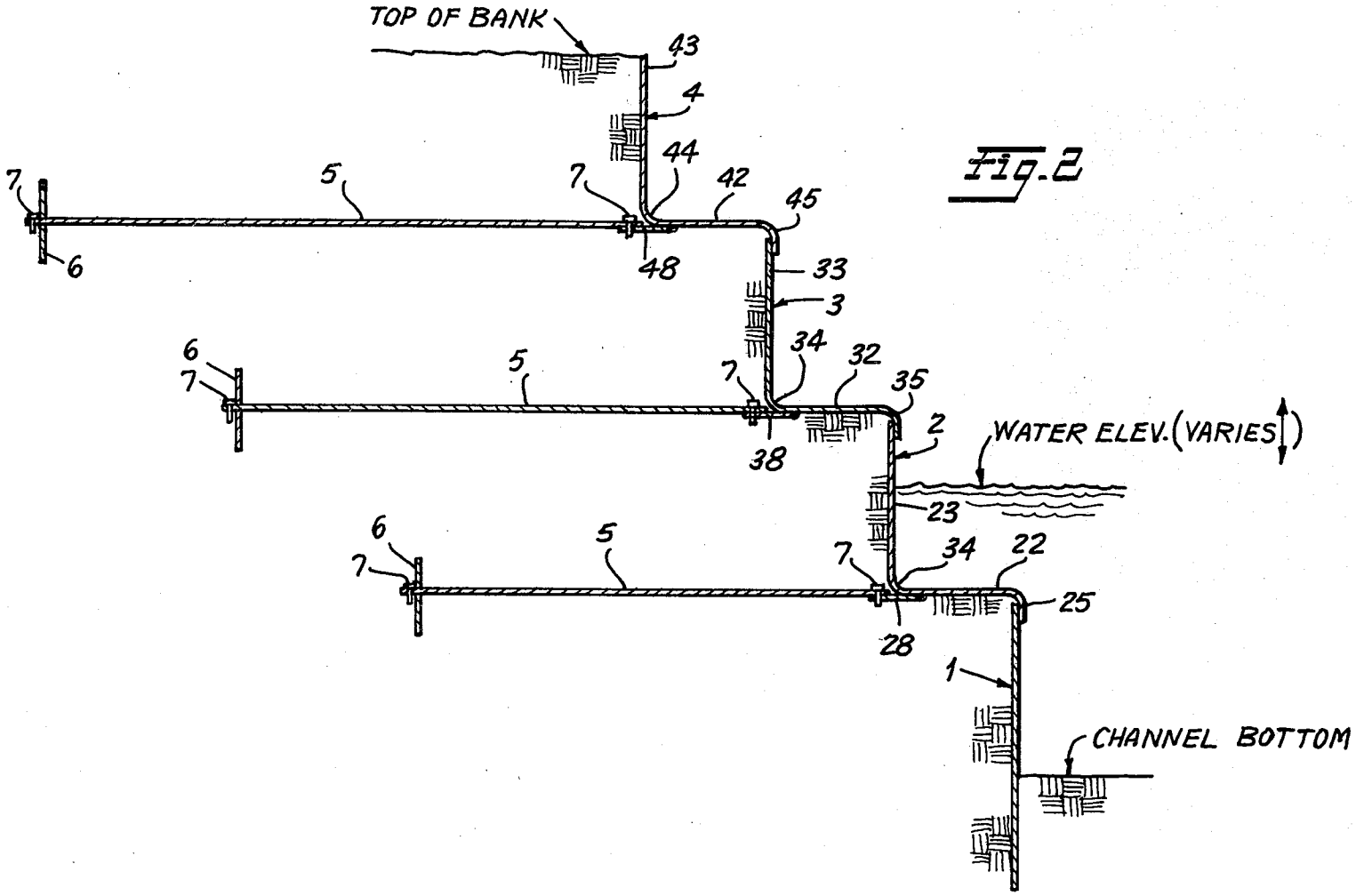
FIG. 2 is a vertical sectional view through the panel assembly of FIG. 1, showing in greater detail the anchoring system and the arrangement of the panels.

The first of the two preferred embodiments is shown in FIGS. 1 and 2, to which reference is now made. In this embodiment the panels are shown at 1, 2, 3 and 4, stacked vertically upon one another to extend between the channel bottom and the top of the watercourse bank. Obviously, the number of panels actually utilized will vary, depending upon the height of the top of the bank above the channel bottom. The panels 1, 2, 3 and 4 are all formed of sheet steel, and preferably of what has come to be known as weathering steel, which has the characteristic of forming a rust coating which then protects the steel from further deterioration. Panel 1 is a flat sheet, whereas the panels 2, 3 and 4 are all generally L-shaped in cross-section so that they have horizontal surfaces 22, 32 and 42, vertical surfaces 23, 33 and 43, and rounded connecting sections 24, 34 and 44, respectively. Further, the outer edges of the horizontal surfaces 22, 32 and 42 have downturned lips 25, 35 and 45, respectively, thereon, that engage over the top edge of the panel therebeneath.

The undersurfaces of the panels 2, 3 and 4 have lugs 28, 38 and 48, respectively, secured thereto to project rearwardly from the rounded connecting sections 24, 34 and 44, there being a plurality of these on each panel in spaced relationship, say several feet apart. The lugs 28, 38 and 48 are part of the anchoring system for the panels. The panels 2, 4 and 6 are also provided with weep hole openings 9, to relieve water pressure therebehind.

The bottommost, vertical panel 1 is placed first, with the lower portion thereof embedded in the earth so that it extends below the channel bottom. The panel 1 is formed at the factory, and carried to the site for installation. Usually, installation can be completed with a minimum of digging and driving of the panel, using hand tools. Then, the placement of panel 2 occurs, the panel being positioned with the lip 25 overlapping panel 1. The area behind panel 1 is first filled with earth to the top thereof, to the extent required, and an anchor strap 5 is secured at one end thereof by a retaining pin 7 or the like to each of the lugs 28 on the panel 2. Deadmen 6 in the form of rectangular plates are mounted on the other ends of the straps 5, the straps being poised through the plates and secured by pins 7. Dirt is then placed on the strap 5 and the deadman 6, which serves to anchor the panel 2.

A further fill to the extent needed is then made behind panel 2, and an anchor strap 5 and deadman 6 are attached to each of the lugs 38. The panel 3 is then installed, followed by the panel 4. In each case, dirt placed on the deadman 6 anchor the panels.

From FIGS. 1 and 2, it is seen that the resultant slope protection system provides a stepped slope of attractive appearance. If plantings are wanted, holes can be formed in the panels where desired, and the plantings made directly into the retained earth. The deadman 6 and anchor straps 5, which can be made of a non-corrosive material, will securely hold the panels 1, 2, 3 and 4 in place, the straps 5 extending in general alignment with the horizontal legs of the panels 2, 3 and 4 which assures the best anchoring of each panel, and the downturned lips 25, 35 and 45 retaining the top edge of the panel therebelow. The result is a well protected slope that is more attractive than in the past, in addition to being much less expensive in terms of both cost and environmental damage.

Figure 3:
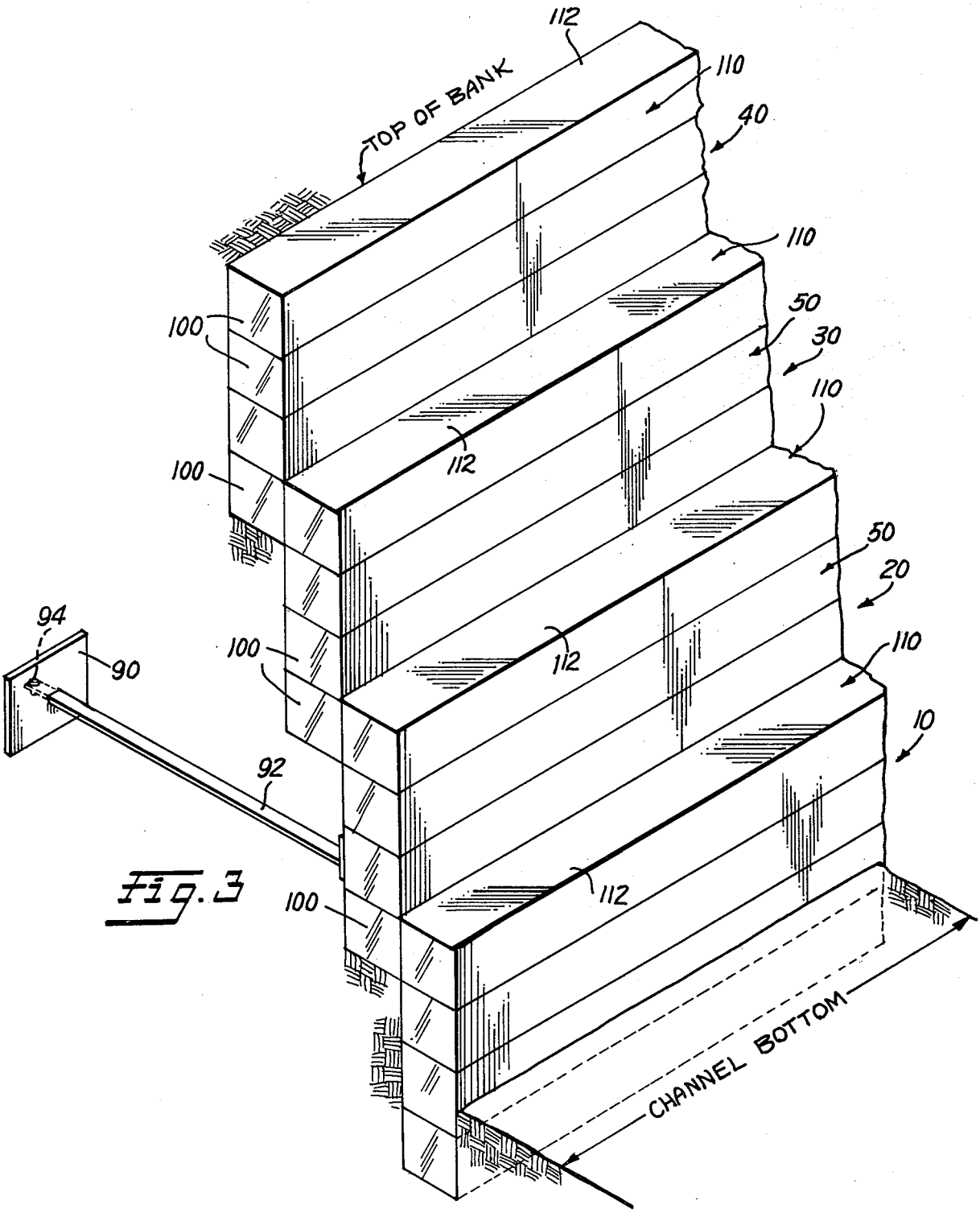
FIG. 3 is a perspective, diagrammatic view showing a second embodiment of the channel panel erosion protection system of the invention, utilizing panels comprised of rectangular extruded sections.
Figures 4, 5:
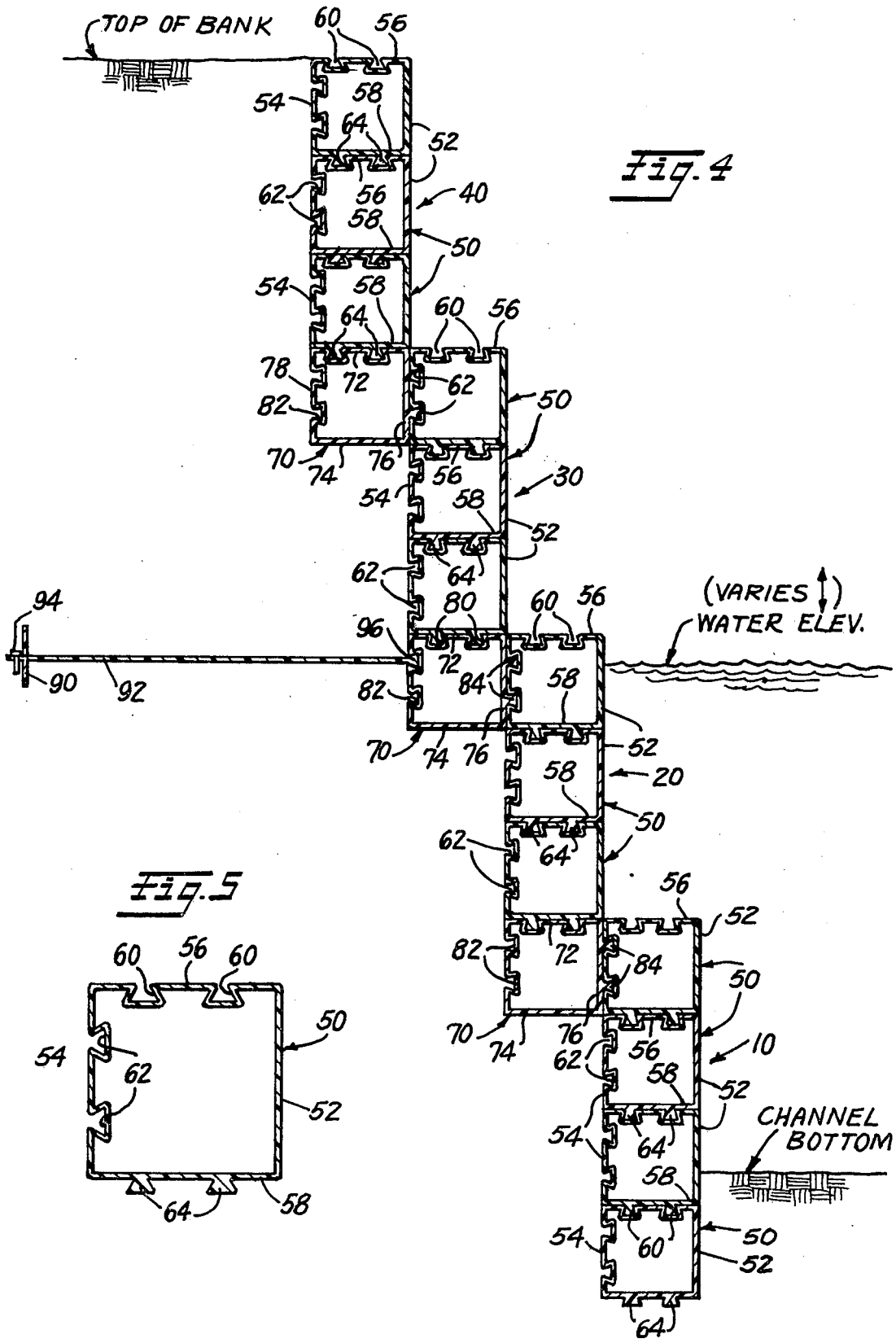
FIG. 4 is a vertical sectional view through a panel assembly similar to that of FIG. 3, showing how the extruded panel sections are interconnected with tongues and grooves, and wherein the top wall of the uppermost section of each panel has parallel grooves therein.
FIG. 5 is an enlarged cross-section of one of the extruded rectangular panel sections of FIG. 4.

Turning now to FIGS. 3–5, the second embodiment of the invention is shown wherein panels 10, 20, 30 and 40 are shown, each panel being comprised of panel sections 50 formed as elongated rectangular extrusions. Referring to FIG. 5, each panel section 50 includes a front wall 52, a rear wall 54, a top wall 56 and a bottom wall 58. The front wall 52 is plain and uninterrupted, and together the front walls 52 of the sections 50 in each panel define the surface of the slope protecting system.

The top and rear walls 56 and 54 of the panel sections 50 have a pair of elongated, parallel grooves 60 and 62, respectively, formed therein, and the bottom portion 58 carries mating, parallel tongues 64. The sides of the grooves 60 and 62 and of the tongues 64 are sloped to form an interlock arrangement, as shown in the drawings. To form one of the panels 10, 20, 30 or 40, sections 50 are assembled to each other by sliding the tongues 64 of one section into the grooves 60 of another, a sufficient number of sections 50 being employed to provide the height desired.

Referring in particular to FIG. 4, it is noted that the panels 10, 20, 30 and 40 are arranged in stepped relationship, much as in FIGS. 1 and 2. To achieve this, special connecting panel sections 70 are utilized as the bottommost section for the panels 20, 30 and 40. The connecting panel sections 70 are similar to the sections 50, and include top, bottom, front and rear walls 72, 74, 76 and 78, respectively, the top wall 72 and the rear wall 74 having parallel grooves 80 and 82 formed therein, with angled sidewalls.

The connecting panel section front walls 76, however, carry parallel tongues 84 thereon, to connect with the parallel grooves 62 in the rear wall of the topmost section 50 of the panel therebeneath. This serves to permanently interconnect the panels. The bottom walls 74 are shown in the drawings not to carry parallel tongues, although these can be placed thereon if so desired. However, since the bottom walls of the connecting panel sections 70 are not joined to other sections, the tongues are usually not needed.

Anchoring of the panels 10, 20, 30 and 40 is achieved in a manner similar to the panels 1, 2, 3 and 4. Again, deadmen 90 in the form of rectangular plates are employed, and anchor straps 92, to which the deadmen are secured by pins 94. The outer ends 96 of the straps 92 are wedge shaped, and are receivable in the rear grooves 62 or 82. While only one anchor strap 92 is shown in FIG. 4, it is to be understood that normally a plurality will be employed, as required for each panel. Again, the straps 92 are placed at the bottom of each panel, where a horizontal step is formed.

The panels 10, 20, 30 and 40 are installed in the same manner as the panels 1, 2, 3 and 4, with the bottommost panel 10 being installed first, after which fill to the extent needed is placed therebehind. The interlocking tongues and grooves will normally fit with some looseness, so that water pressure behind the panels can escape. The hollow panel sections 50 and 70 assure light weight for the sections, and also provide conduits for stringing electrical wires and the like. The sections 50 and 70 are extruded from a suitable plastic, and the plastic can be permanently colored as desired to provide a maintenance free appearance of the desired color. Referring to FIG. 3, the ends of the extruded sections 50 and 70 are covered with caps 100. It is to be understood that the sections 50 and 70 can be installed directly in register with each other, or in a staggered manner, as desired. It is also to be understood that the material used for the sections 50 and 70 can be varied, as can the specific arrangement, shape and location of the tongue and groove elements provided an interlock is maintained.

Finally, if desired separately formed sections 110, as shown in FIG. 3, can be utilized for the topmost section of each panel 10, 20, 30 and 40, the section 100 being identical to the section 50 except that the parallel grooves 60 in the top wall 56 of the sections 50 are not used in the sections 110. Rather, the top walls 112 of the sections 110 are plain.

Obviously, many modifications and variations of the present invention are possible.

I claim:

1. A system of panels and accessory anchoring devices for providing erosion protection to the slopes of a watercourse, including:

a plurality of panels of a weight such that each is man portable, and designed to be placed vertically one upon the other along a watercourse slope;

said panels each being made of a plurality of hollow sections designed and constructed to mate with each other, each of said sections being extruded in a hollow rectangular configuration from light weight material, the mating surfaces of the sections carrying interlocking, longitudinally extending tongue and groove means thereon, and the hollow interiors thereof accommodating the reception of other material and items within the sections and the panels formed thereby;

a plurality of deadman elements, for burying in the earth fill placed behind each panel; and means connecting said deadman elements with the rear sides of said panels, whereby when said deadman elements are buried in the earth fill said panels will be secured in position.

2. A system of panels and accessory anchoring devices as recited in claim 1, wherein said means connecting said deadman elements to said panels includes a tie member having on one end thereof a wedge-shaped element receivable in the interlocking grooves on said sections.

3. A system of panels and accessory anchoring devices for providing erosion protection to the slopes of a watercourse, including:

a first, bottommost vertical panel having a weight such that it is man portable, said first panel being placed at the edge of the bed of said watercourse;

a first layer of earth fill, placed behind said bottommost vertical panel and generally level with the top thereof;

a second panel placed atop said first panel and engaged therewith, said second panel also having a weight such that it is man portable;

said panels each being made of a plurality of hollow sections designed and constructed to mate with each other, each of said sections being extruded in a hollow rectangular configuration from light weight material, the mating surfaces of the sections carrying interlocking, longitudinally extending tongue and groove means thereon, and the hollow interiors thereof accommodating the reception of other material and items within the sections and the panels formed thereby;

at least one deadman element placed upon said first layer of earth fill, rearwardly of said first and second panels;

means connecting said deadman element with at least said second panel, including a tie member having on one end thereof a wedge-shaped element receivable in the interlocking grooves on said sections; and a second layer of earth fill, placed upon said first layer behind said second panel, and covering said deadman element and said connecting means.

4. A panel for use in providing erosion protection to the slopes of a watercourse, comprising:

a plurality of hollow sections designed and constructed to mate with each other in interlocking relationship, each of said sections being extruded from a light weight material in a hollow rectangular configuration and the outer surfaces thereof being substantially flat for mating with like surfaces on adjacent sections, the mating flat surfaces of the sections carrying interlocking, longitudinally extending tongue and groove means thereon, and the hollow interiors thereof accommodating the reception of other material and items within said sections and the panels formed thereby.

* * * * *